US006663349B1

(12) United States Patent
Discenzo et al.

(10) Patent No.: US 6,663,349 B1
(45) Date of Patent: Dec. 16, 2003

(54) SYSTEM AND METHOD FOR CONTROLLING PUMP CAVITATION AND BLOCKAGE

(75) Inventors: Frederick M. Discenzo, Brecksville, OH (US); Dukki Chung, Mayfield Heights, OH (US); Joseph K. Zevchek, Brunswick, OH (US)

(73) Assignee: Reliance Electric Technologies, LLC, Mayfield Heights, OH (US)

( * ) Notice: Subject to any disclaimer, the term of this patent is extended or adjusted under 35 U.S.C. 154(b) by 79 days.

(21) Appl. No.: 09/965,461

(22) Filed: Sep. 27, 2001

Related U.S. Application Data

(60) Provisional application No. 60/273,022, filed on Mar. 2, 2001.

(51) Int. Cl.[7] ..... F04B 49/00

(52) U.S. Cl. ..... 417/44.1; 417/300

(58) Field of Search ..... 417/44.1, 300; 303/155; 60/246; 210/198.2; 137/14; 141/1

(56) References Cited

U.S. PATENT DOCUMENTS

| | | | | |
|---|---|---|---|---|
| 4,119,016 A | | 10/1978 | Pfeil et al. | |
| 4,278,051 A | | 7/1981 | Shida | |
| 4,399,663 A | | 8/1983 | Hesler | |
| 4,512,722 A | | 4/1985 | Mouton | |
| 4,650,633 A | | 3/1987 | Youngborg | |
| 4,856,284 A | | 8/1989 | Mattiola et al. | |
| 4,881,374 A | | 11/1989 | Mattiola et al. | |
| 4,881,375 A | | 11/1989 | Mattiola et al. | |
| 4,887,857 A | * | 12/1989 | VanOmmeren | 141/1 |
| 4,909,076 A | | 3/1990 | Busch et al. | |
| 4,934,399 A | * | 6/1990 | Cho | 137/14 |
| 5,234,587 A | * | 8/1993 | Allington et al. | 210/198.2 |
| 5,284,523 A | | 2/1994 | Badami et al. | |
| 5,332,356 A | | 7/1994 | Gulich | |
| 5,861,560 A | | 1/1999 | Harvey | |
| 6,047,545 A | * | 4/2000 | Deininger | 60/246 |
| 6,145,332 A | | 11/2000 | Hyde | |
| 6,241,485 B1 | * | 6/2001 | Warwick | 417/300 |
| 6,260,004 B1 | | 7/2001 | Hays et al. | 702/183 |
| 6,330,525 B1 | | 12/2001 | Hays et al. | 702/183 |
| 6,422,662 B1 | * | 7/2002 | Haas | 303/155 |
| 2002/0123856 A1 | * | 9/2002 | Eryurek | 702/140 |

FOREIGN PATENT DOCUMENTS

| | | | | |
|---|---|---|---|---|
| JP | 361244896 | * | 10/1986 | F04D/29/66 |
| JP | 62048993 | * | 3/1987 | F04D/15/00 |

* cited by examiner

*Primary Examiner*—Sang Y. Paik
*Assistant Examiner*—Leonid M Fastovsky
(74) *Attorney, Agent, or Firm*—Amin & Turocy, LLP; Alexander M. Gerasimow; William R. Walbrun

(57) ABSTRACT

A pump control system and a controller therefor are disclosed which operate a motorized pump in a controlled fashion. The controller provides a control signal to a motor drive according to a setpoint or according to a cavitation signal from a cavitation detection component in the controller. If the cavitation detection component determines that pump cavitation is likely or suspected, the controller may operate the pump motor according to the cavitation signal, in order to reduce or eliminate the cavitation condition, before resuming normal control according to the setpoint.

39 Claims, 5 Drawing Sheets

SYSTEM AND METHOD FOR CONTROLLING PUMP CAVITATION AND BLOCKAGE

CROSS-REFERENCE TO RELATED APPLICATIONS

The present application claims the benefit of U.S. Provisional Patent Application Ser. No. 60/273,022, filed Mar. 2, 2001, entitled SYSTEM AND METHOD FOR CONTROLLING PUMP CAVITATION AND BLOCKAGE.

TECHNICAL FIELD

The present invention relates to the art of industrial controllers, and more particularly to a control system and methodology for controlling pump cavitation and blockage.

BACKGROUND OF THE INVENTION

Motorized pumps are employed in industry for controlling fluid flowing in a pipe, fluid level in a tank or container, or in other applications, wherein the pump receives fluid via an intake and provides fluid to an outlet at a different (e.g., higher) pressure and/or flow rate. Such pumps may thus be employed to provide outlet fluid at a desired pressure (e.g., pounds per square inch or PSI), flow rate (e.g., gallons per minute or GPM), or according to some other desired parameter associated with the performance of a system in which the pump is employed. For example, the pump may be operatively associated with a pump control system implemented via a programmable logic controller (PLC) coupled to a motor drive, which controls the pump motor speed in order to achieve a desired outlet fluid flow rate, and which includes I/O circuitry such as analog to digital (A/D) converters for interfacing with sensors and outputs for interfacing with actuators associated with the controlled pump system. In such a configuration, the control algorithm in the PLC may receive process variable signals from one or more sensors associated with the pump, such as a flow meter in the outlet fluid stream, and may make appropriate adjustments in the pump motor speed such that the desired flow rate is realized.

In conventional motorized pump control systems, the motor speed is related to the measured process variable by a control scheme or algorithm, for example, where the measured flow rate is compared with the desired flow rate (e.g., setpoint). If the measured flow rate is less than the desired or setpoint flow rate, the PLC may determine a new speed and send this new speed setpoint to the drive in the form of an analog or digital signal. The drive may then increase the motor speed to the new speed setpoint, whereby the flow rate is increased. Similarly, if the measured flow rate exceeds the desired flow rate, the motor speed may be decreased. Control logic within the control system may perform the comparison of the desired process value (e.g., flow rate setpoint) with the measured flow rate value (e.g., obtained from a flow sensor signal and converted to a digital value via a typical A/D converter), and provide a control output value, such as a desired motor speed signal, to the motor drive according to the comparison.

The control output value in this regard, may be determined according to a control algorithm, such as a proportional, integral, derivative (PID) algorithm, which provides for stable control of the pump in a given process. The motor drive thereafter provides appropriate electrical power, for example, three phase AC motor currents, to the pump motor in order to achieve the desired motor speed to effectuate the desired flow rate in the controlled process. Load fluctuations or power fluctuations which may cause the motor speed to drift from the desired, target speed are accommodated by logic internal to the drive. The motor speed is maintained in this speed-control manner based on drive logic and sensed or computed motor speed.

Motorized pumps, however, are sometimes subjected to process disturbances, which disrupt the closed loop performance of the system. In addition, one or more components of the process may fail or become temporarily inoperative, such as when partial or complete blockage of an inlet or outlet pipe occurs, when a pipe breaks, when a coupling fails, or when a valve upstream of the pump fluid inlet or downstream of the pump discharge fluid outlet becomes frozen in a closed position. In certain cases, the form and/or nature of such disturbances or failures may prevent the motorized pump from achieving the desired process performance. For instance, where the pump cannot supply enough pressure to realize the desired outlet fluid flow rate, the control system may increase the pump motor speed to its maximum value. Where the inability of the pump to achieve such pressure is due to inadequate inlet fluid supply, partially or fully blocked outlet passage, or some other condition, the excessive speed of the pump motor may cause damage to the pump, the motor, or other system components.

Some typical process disturbance conditions associated with motorized pumps include pump cavitation, partial or complete blockage of the inlet or outlet, and impeller wear or damage. Cavitation is the formation of vapor bubbles in the inlet flow regime or the suction zone of the pump, which can cause accelerated wear, and mechanical damage to pump seals, bearing and other pump components, mechanical couplings, gear trains, and motor components. This condition occurs when local pressure drops to below the vapor pressure of the liquid being pumped. These vapor bubbles collapse or implode when they enter a higher-pressure zone (e.g., at the discharge section or a higher pressure area near the impeller) of the pump, causing erosion of impeller casings as well as accelerated wear or damage to other pump components.

If a pump runs for an extended period under cavitation conditions, permanent damage may occur to the pump structure and accelerated wear and deterioration of pump internal surfaces, bearings, and seals may occur. If left unchecked, this deterioration can result in pump failure, leakage of flammable or toxic fluids, or destruction of other machines or processes for example. These conditions may represent an environmental hazard and a risk to humans in the area. Thus, it is desirable to provide improved controllers and pump control systems for motorized pumps, which minimize or reduce the damage or wear associated with pump cavitation and other process disturbances, failures, and/or faults associated with motorized pumps and pumping processes.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter. The invention provides control apparatus and methods by which damage and other problems associated with motorized pump cavitation or other faults may be minimized or eliminated, and which provide for specialized control of pumps during actual or suspected cavitation conditions or other process upset conditions, and for possible resumption of normal control once an actual or suspected cavitation condition ends.

One aspect of the invention provides a pump control system for operating a motorized pump in a controlled fashion. The control system comprises a motor drive providing electrical power to operate the pump motor according to a motor control signal, and a controller with a cavitation detection component operatively connected to the pump system (e.g., which may include sensors on the pump or connecting pipes) to detect actual or suspected cavitation in the pump. The controller provides the control signal to the motor drive which represents a determined desired motor speed value. The desired motor speed, in turn, is based on a pump system setpoint or a cavitation signal determined from the cavitation detection component according to control logic for avoiding or preventing cavitation in the pump. In this manner, the controller accounts for actual, likely, or incipient cavitation conditions in providing the motor control signal.

For instance, where cavitation is suspected, the controller may provide the control signal according to the cavitation signal, which may operate to slow the motor down to avoid actual cavitation and/or until an actual cavitation condition subsides, whereby damage or premature wear heretofore experienced as a result of pump cavitation may be avoided or reduced. The controller may maintain such pump operation until the cavitation condition (e.g., actual or suspected) ends, whereafter normal control is resumed, or alternatively the controller may operate the pump near the cavitation condition to prevent unstable operation. The cavitation detection component of the system may detect actual, likely, or incipient cavitation through one or more computations based on measured process values and stored process and equipment data. For example, cavitation may be suspected when net positive suction required exceeds or is near net positive suction available in the pump.

Another aspect of the invention provides a controller for providing a control signal to a motor drive to operate a motorized pump in a controlled fashion. The controller may comprise a cavitation detection component adapted to detect cavitation in the pump, wherein the controller provides the control signal to the motor drive according to a setpoint or a cavitation signal from the cavitation detection component according to detected cavitation in the pump.

Still another aspect of the invention provides a method of controlling a motorized pump, by which damage or other deleterious effects previously associated with cavitation in a motorized pump are alleviated. The method may comprise detecting cavitation in the pump, controlling the pump according to a process setpoint if no cavitation is detected in the pump, and controlling the pump according to a cavitation signal if cavitation is detected in the pump. The method may be advantageously employed in order to reduce or eliminate the previously encountered problems associated with motorized pump cavitation.

Yet another aspect of the invention provides a method to control a pump according to a process setpoint if sufficiently far from any possible cavitation condition. If a cavitation detection signal indicates no cavitation, but the process is sufficiently near possible cavitation, then the method may be advantageously employed to maintain a suitable margin away from possible cavitation.

Another aspect of the invention provides a method to control a pump according to a process setpoint if sufficiently far from any possible cavitation condition. If cavitation is detected to a slight degree, the method may be advantageously employed to limit the degree of cavitation and to prevent severe cavitation, but to permit the process to continue with a controlled minimum amount of cavitation. Such conditions may be required, for example, when emptying a tank car and insufficient head is available for the minimum flow required to empty the tank without cavitation.

Yet another aspect of the invention provides a method to control a pump according to a process setpoint if sufficiently far from any possible cavitation condition. If cavitation is detected to a slight degree, the method may be advantageously employed to increase the degree of cavitation slightly to prevent severe cavitation but also to avoid a minimum cavitation condition which may be more damaging to equipment then a slightly greater degree of cavitation. This will permit the process to continue with a controlled target amount of cavitation and controlled machinery damage and wear.

To the accomplishment of the foregoing and related ends, the invention, then, comprises the features hereinafter fully described. The following description and the annexed drawings set forth in detail certain illustrative aspects of the invention. However, these aspects are indicative of but a few of the various ways in which the principles of the invention may be employed. Other aspects, advantages and novel features of the invention will become apparent from the following detailed description of the invention when considered in conjunction with the drawings.

DETAILED DESCRIPTION OF THE INVENTION

Figure 1:
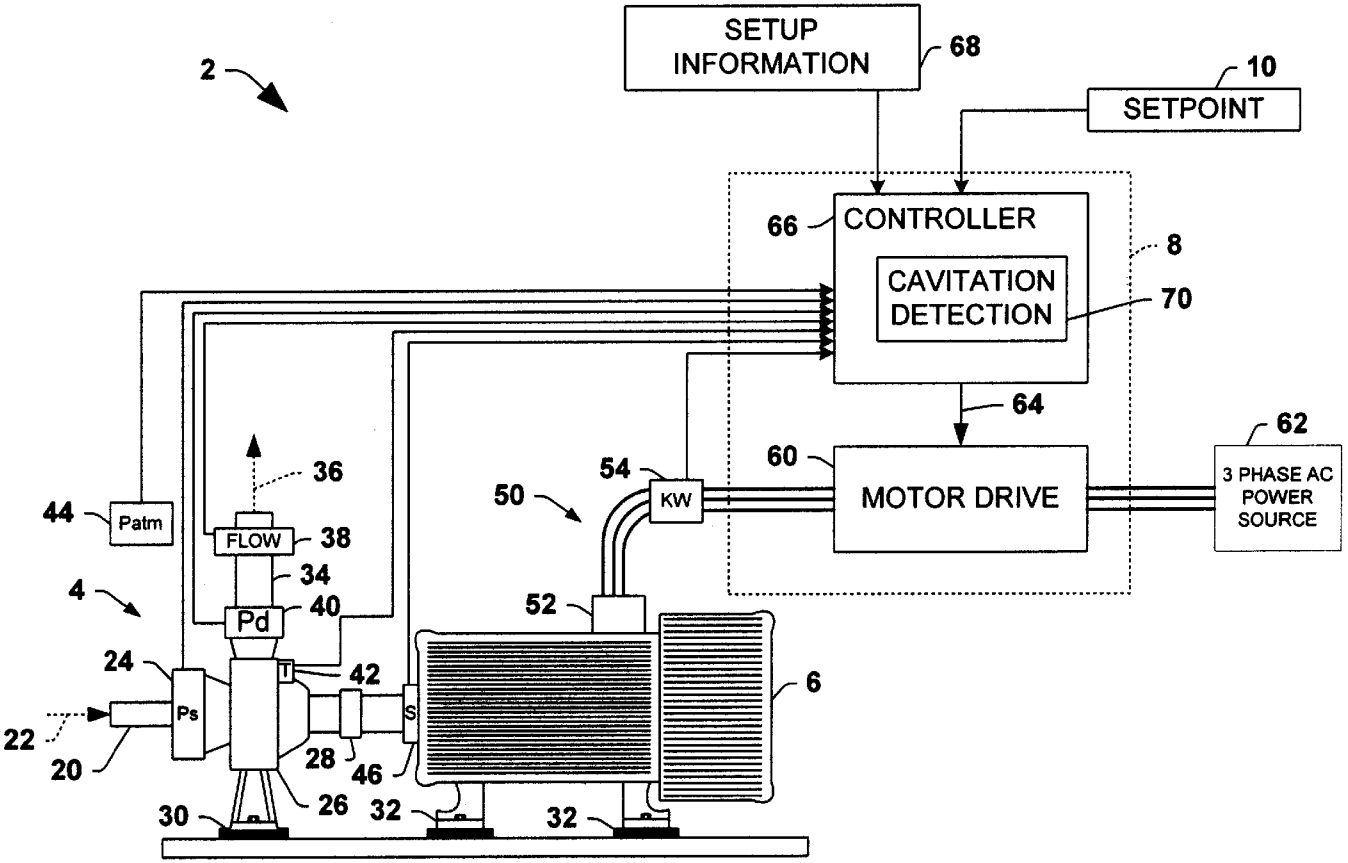
FIG. 1 is a side elevation view illustrating an exemplary motorized pump system and a control system therefor with a cavitation detection component in accordance with an aspect of the present invention.

The various aspects of the present invention will now be described with reference to the drawings, wherein like reference numerals are used to refer to like elements throughout. The invention provides control apparatus and methodologies by which damage and other deleterious effects associated with motorized pump cavitation may be reduced or eliminated. The invention may thus be employed to operate a pump under normal conditions to achieve a desired process performance, to operate in a different mode when cavitation and/or blockage exists or is suspected, in order to reduce or end the cavitation, and to resume normal control once the actual or suspected cavitation condition ends.

Referring initially to FIG. 1, an exemplary motorized pump system 2 is illustrated having a pump 4, a three phase electric motor 6, and a control system 8 for operating the system 2 in accordance with a setpoint 10. Although the exemplary motor 6 is illustrated and described herein as a polyphase synchronous electric motor, the various aspects of the present invention may be employed in association with single phase motors as well as with DC and other types of motors. In addition, the pump 4 may comprise a centrifugal type pump, however, the invention finds application in association with other pump types not illustrated herein, for example, positive displacement pumps. The control system 8 operates the pump 4 via the motor 6 according to the setpoint 10 and one or more measured process variables, in order to maintain operation of the system 2 commensurate with the setpoint 10 and within the allowable process operating ranges specified in Setup Information 68. For example, it may be desired to provide a constant fluid flow, wherein the value of the setpoint 10 is a desired flow rate in gallons per minute (GPM) or other engineering units.

The pump 4 comprises an inlet opening 20 through which fluid is provided to the pump 4 in the direction of arrow 22 as well as a suction pressure sensor 24, which senses the inlet or suction pressure at the inlet 20 and provides a corresponding suction pressure signal to the control system 8. Fluid is provided from the inlet 20 to an impeller housing 26 including an impeller (not shown), which rotates together with a rotary pump shaft coupled to the motor 6 via a coupling 28. The impeller housing 26 and the motor 6 are mounted in a fixed relationship with respect to one another via a pump mount 30, and motor mounts 32. The impeller with appropriate fin geometry rotates within the housing 26 so as to create a pressure differential between the inlet 20 and an outlet 34 of the pump. This causes fluid from the inlet 20 to flow out of the pump 4 via the outlet or discharge tube 34 in the direction of arrow 36. The flow rate of fluid through the outlet 34 is measured by a flow sensor 38, which provides a flow rate signal to the control system 8.

In addition, the discharge or outlet pressure is measured by a pressure sensor 40, which is operatively associated with the outlet 34 and provides a discharge pressure signal to the control system 8. It will be noted at this point that although one or more sensors (e.g., suction pressure sensor 24, discharge pressure sensor 40, outlet flow sensor 38, and others) are illustrated in the exemplary system 2 as being associated with and/or proximate to the pump 4, that such sensors may be located remote from the pump 4, and may be associated with other components in a process or system (not shown) in which the pump system 2 is employed. Alternatively, flow may be approximated rather than measured by utilizing pressure differential information, pump speed, fluid properties, and pump geometry information or a pump model. Alternatively or in combination, inlet and/or discharge pressure values may be estimated according to other sensor signals and pump/process information.

In addition, it will be appreciated that while the motor drive 60 is illustrated in the control system 8 as separate from the motor 6 and from the controller 66, that some or all of these components may be integrated. Thus, for example, an integrated, intelligent motor may be provided with the motor 6, the motor drive 60 and the controller 66. Furthermore, the motor 6 and the pump 4 may be integrated into a single unit (e.g., having a common shaft wherein no coupling 28 is required), with or without integral control system (e.g., control system 8, comprising the motor drive 60 and the controller 66) in accordance with the invention.

The control system 8 further receives process variable measurement signals relating to pump temperature via a temperature sensor 42, atmospheric pressure via a pressure sensor 44 located proximate the pump 4, and motor (pump) rotational speed via a speed sensor 46. The motor 6 provides rotation of the impeller of the pump 4 according to three-phase alternating current (AC) electrical power provided from the control system via power cables 50 and a junction box 52 on the housing of the motor 6. The power to the pump 4 may be determined by measuring the current provided to the motor 6 and computing pump power based on current, speed, and motor model information. This may be measured and computed by a power sensor 54, which provides a signal related thereto to the control system 8. Alternatively or in combination, the motor drive 60 may provide motor torque information to the controller 66 where pump input power is calculated according to the torque and possibly speed information.

The control system 8 also comprises a motor drive 60 providing three-phase electric power from an AC power source 62 to the motor 6 via the cables 50 in a controlled fashion (e.g., at a controlled frequency and amplitude) in accordance with a control signal 64 from a controller 66. The controller 66 receives the process variable measurement signals from the atmospheric pressure sensor 44, the suction pressure sensor 24, the discharge pressure sensor 40, the flow sensor 38, the temperature sensor 42, the speed sensor 46, and the power sensor 54, together with the setpoint 10, and provides the control signal 64 to the motor drive 60 in order to operate the pump system 2 commensurate with the setpoint 10. In this regard, the controller 66 may be adapted to control the system 2 to maintain a desired fluid flow rate, outlet pressure, motor (pump) speed, torque, suction pressure, or other performance characteristic. Setup information 68 may be provided to the controller 66, which may include operating limits (e.g., min/max speeds, min/max flows, min/max pump power levels, min/max pressures allowed, NPSHR values, and the like), such as are appropriate for a given pump 4, motor 6, and piping and process conditions.

Figure 2:
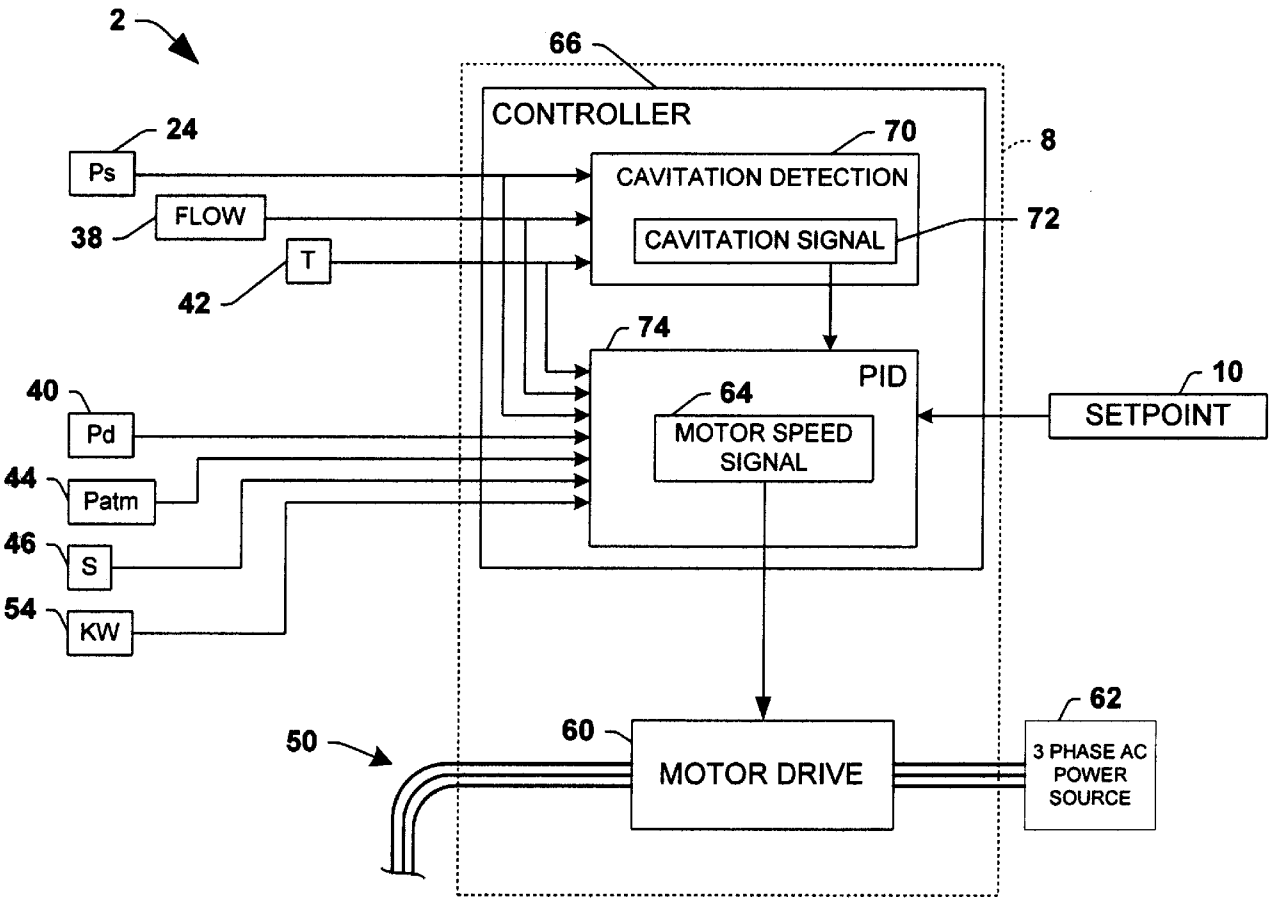
FIG. 2 is a schematic diagram illustrating further details of the exemplary control system of FIG. 1.

Referring also to FIG. 2, the controller 66 comprises a cavitation detection component 70, which is adapted to detect actual or likely cavitation in the pump 4, according to an aspect of the invention. The cavitation detection component 70 may also determine incipient cavitation or the degree of margin before cavitation is likely to occur. Furthermore, the controller 66 selectively provides the control signal 64 to the motor drive 60 according to the setpoint 10 (e.g., in order to maintain or regulate a desired flow rate) or a cavitation signal 72 from the cavitation detection component 70 according to detected (e.g., actual, suspected, or incipient or within a margin of possible) cavitation in the pump.

In this regard, the controller 66 may provide the control signal 64 as a motor speed signal 64 from a PID control component 74, which inputs process values from one or more of the sensors 24, 38, 40, 42, 44, 46, and 54, and the setpoint 10, wherein the magnitude of change in the control signal 64 may be related to the degree of correction required to accommodate the present control strategy, for example, such as the degree of cavitation detected, or the error in required versus measured process variable (e.g., flow). Although the exemplary controller 66 is illustrated and described herein as comprising a PID control component 74, control systems and controllers implementing other types of control strategies or algorithms (e.g., PI control, PID with additional compensating blocks or elements, non-linear control, state-space control, model reference, fuzzy logic, or the like) are also contemplated as falling within the scope of the present invention.

For instance, the exemplary PID component 74 may compare a measured process variable (e.g., flow rate measured by sensor 38) with the setpoint 10 where the setpoint 10 is a target setpoint flow rate, wherein one or more of the process variable(s) and/or the setpoint may be scaled accordingly, in order to determine an error value (not shown). The error value may then be used to generate the motor speed signal 64, wherein the signal 64 may vary proportionally according to the error value, and/or the derivative of the error, and/or the integral of the error, according to known PID control methods.

The controller 66 may comprise hardware and/or software (not shown) in order to accomplish control of the process 2. For example, the controller 66 may comprise a microprocessor (not shown) executing program instructions for implementing PID control (e.g., PID component 74), detecting actual, suspected, or marginal pump cavitation (e.g., cavitation detection component 70), inputting of values from the sensor signals, providing the control signal 64 to the motor drive 60, and interacting with a user via a user interface (not shown). Such a user interface may allow a user to input setpoint 10, setup information 68, and other information, and in addition may render status and other information to the user, such as system conditions, operating mode, diagnostic information, and the like, as well as permitting the user to start and stop the system and override previous operating limits and controls. The controller 66 may further include signal conditioning circuitry for conditioning the process variable signals from the sensors 24, 38, 40, 42, 44, 46, and/or 54, as well as one or more communications ports or interfaces for communicating with an external computer and/or a network (not shown). In addition, the cavitation detection component 70 of the controller 66 may be implemented as program instructions executed by a microprocessor in the controller 66.

The controller 66, moreover, may be integral with or separate from the motor drive 60. For example, the controller 66 may comprise an embedded processor circuit board mounted in a common enclosure (not shown) with the motor drive 60, wherein sensor signals from the sensors 24, 38, 40, 42, 44, 46, and/or 54 are fed into the enclosure, together with electrical power lines, and wherein the setpoint 10 may be obtained from a user interface (not shown) mounted on the enclosure, and/or via a network connection. Alternatively, the controller 66 may reside as instructions in the memory of the motor drive 60, which may be computed on an embedded processor circuit that controls the motor 6 in the motor drive 60.

In addition, it will be appreciated that the motor drive 60 may further include control and feedback components (not shown), whereby a desired motor speed (e.g., as indicated by the motor speed control signal 64 from the PID component 74) is achieved and regulated via provision of appropriate electrical power (e.g., amplitude, frequency, phasing, etc.) from the source 62 to the motor 6, regardless of load fluctuations, and/or other process disturbances or noise. In this regard, the motor drive 60 may also obtain motor speed feedback information, such as from the speed sensor 46 via appropriate signal connections (not shown) in order to provide closed loop speed control according to the motor speed control signal 64 from the controller 66. In addition, it will be appreciated that the motor drive 60 may obtain motor speed feedback information by means other than the sensor 46 such as through internally computed speed values, as well as torque feedback information, and that such speed feedback information may be provided to the controller 66, whereby the sensor 46 need not be included in the system 2.

In accordance with the invention, the exemplary control system 8 may operate to selectively control the pump 6 according to the setpoint 10 (e.g., via the PID control component 74) and one or more process variable values (e.g., obtained via the sensors 24, 38, 40, 42, 44, 46, and/or 54) where no cavitation is present or suspected in the pump 4, and may modify the control of the pump 4 when cavitation is detected within a range of possible cavitation via the cavitation detection component 70. In this regard, the controller 66 may provide the control signal 64 according to the cavitation signal 72 if the cavitation detection component 70 detects cavitation (e.g., actual, suspected, or marginal) in the pump 4, and according to the setpoint if the cavitation detection component does not detect cavitation (e.g., actual or possible) in the pump.

For example, the control signal 64 may provide for appropriate motor speed to achieve a desired setpoint value of a process variable (e.g., flow rate in the outlet or discharge tube 34) where no cavitation is detected, and selectively slow down the motor 6 or otherwise take appropriate control actions when cavitation (e.g., actual, suspected, or within a margin) is detected in accordance with the cavitation signal 72 from the cavitation detection component 70. It will be further appreciated in this regard, that the controller 66 may provide the control signal 64 according to one of the setpoint 10 and the cavitation signal 72, and further in accordance with one or more of the sensor signals from the sensors 24, 38, 40, 42, 44, 46, and/or 54. For instance, PID control may be achieved wherein the control signal 64 is determined by the PID component 74 according to a comparison of the flow rate signal from sensor 38 with the setpoint 10 when no cavitation is detected. Where cavitation is detected, the control signal 64 may be derived from the cavitation signal 72 as well as from the motor speed signal from the speed sensor 46.

The invention contemplates many variations, for example, in which the cavitation signal 72 is a boolean indication that cavitation has been detected in the pump 4, wherein the PID component 74 may operate in a reduced speed mode according to one or more criteria so as to reduce or eliminate the cavitation condition before resuming control according to the setpoint 10. Other variations may include the cavitation signal 72 being an analog value representative of the degree of cavitation or margin before cavitation occurs, which may be used to modify the setpoint signal 10 in the PID component 74.

Figure 3:
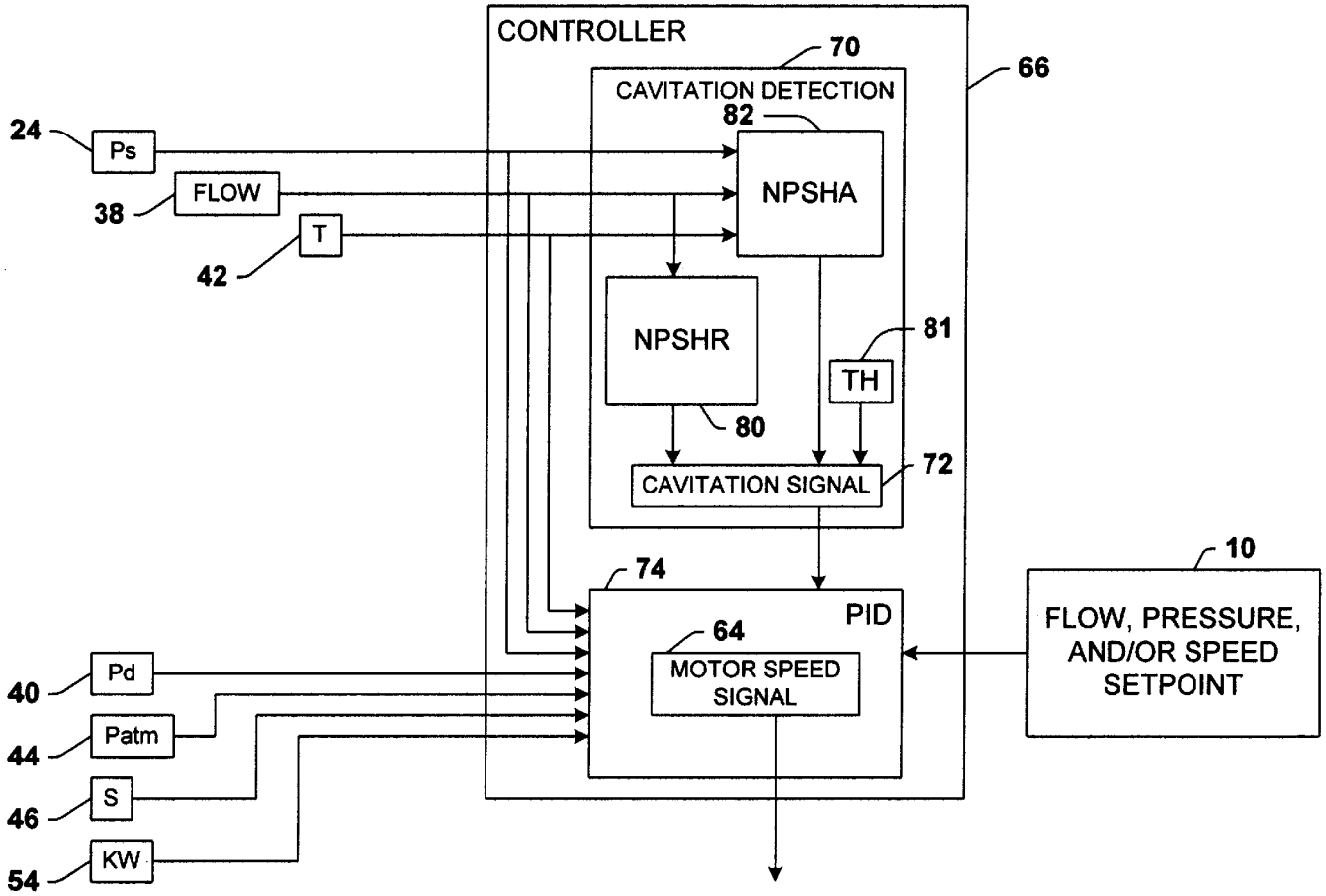
FIG. 3 is a schematic diagram further illustrating the cavitation detection component and controller of FIGS. 1 and 2.

Referring now to FIG. 3, the cavitation detection component 70 may determine the existence or likelihood or margin or degree/severity of pump cavitation based on one or more values obtained from the sensors 24, 38, 40, 42, 44, 46, and/or 54. For example, the cavitation detection component 70 may input values for suction pressure, flow, and pump temperature from the sensors 24, 38, and 42 in order to detect pump cavitation. The cavitation detection may comprise a determination of whether net positive suction head required (NPSHR) 80 is greater than or within a threshold value 81 of net positive suction head available (NPSHA) 82. A comparison of the values 80 and 82 may accordingly yield a determination of whether or not cavitation is likely, and may further provide an indication of the extent of cavitation in the pump 4 and/or a margin of safety before cavitation may occur.

Thus, for example, the cavitation signal 72 may comprise a cavitation value representative of the extent of cavitation, which is employed in the controller 66 to generate the control signal 64. In another variation, the cavitation signal 72 may comprise a boolean value merely indicating whether cavitation is suspected (e.g., NPSHR 80 is greater than or near NPSHA 82) or not (e.g., NPSHA 82 is greater than or equal to NPSHR 80 plus a threshold value 81), in which case the PID component 74 may provide appropriate adjustments to the control signal 64 in order to reduce possible damage to the motor 6, pump 4, or other system components, and/or to actively attempt to avoid, reduce, or eliminate the cavitation (e.g., by slowing down the motor speed).

The exemplary controller 66 may thus operate in one of two modes, e.g., one for normal operation controlling according to the setpoint 10 (e.g., flow, head or pressure, speed), and another where cavitation (e.g., actual or suspected) is detected. Alternatively or in combination, the controller 66 may employ a cavitation control scheme when the pump 4 is near cavitation, such that the pump 4 is not operated at the setpoint 10, and such that the pump 4 is not cavitating. In this regard, the cavitation control scheme may provide for operation of the pump 4 a small margin from the occurrence of cavitation. It will be appreciated that in this fashion, the controller 66 may operate the pump 4 at a stable operating condition where cavitation is prevented, which does not attain the setpoint 10. The user may enter the allowable margin (e.g., such as threshold value 81) from cavitation to be maintained as a parameter in the setup information 68 provided to the controller 66. The threshold value 81 may alternatively or in combination change or be adaptive using other diagnostic algorithms and respond to process and machinery changes. Thus, the control system 8 may avoid unstable operation, for example, wherein the controller 66 eliminated cavitation, then went back to the user setpoint 10, then detected cavitation (e.g., actual or suspected), and oscillated between cavitation and non-cavitation modes. Rather the controller 66 may operate to control the pump 4 to a value or delta around the cavitation condition, in order to prevent the pump system 2 from becoming unstable. Alternatively, the controller 66 may adaptively establish an appropriate margin from cavitation based on the stability of the system and the frequency of excursion into and out of cavitation as outlined above.

According to another aspect of the invention, the controller 66 may operate to prevent damage to system components in the event that the outlet tube 34 or pipes connected thereto, become partially or completely blocked, pump or pipe leakage occurs, or in the event of a sensor failure. In this situation, the controller 66 may advantageously sense that the outlet or discharge pressure (e.g., head) at sensor 40 is high, but at the same time the flow rate (e.g., sensor 38) is low or zero. In this situation, the controller 66 may be adapted not to increase motor speed to meet the flow setpoint 10, but rather to shut down the system 2 in order to prevent damage to system components.

Figure 4:
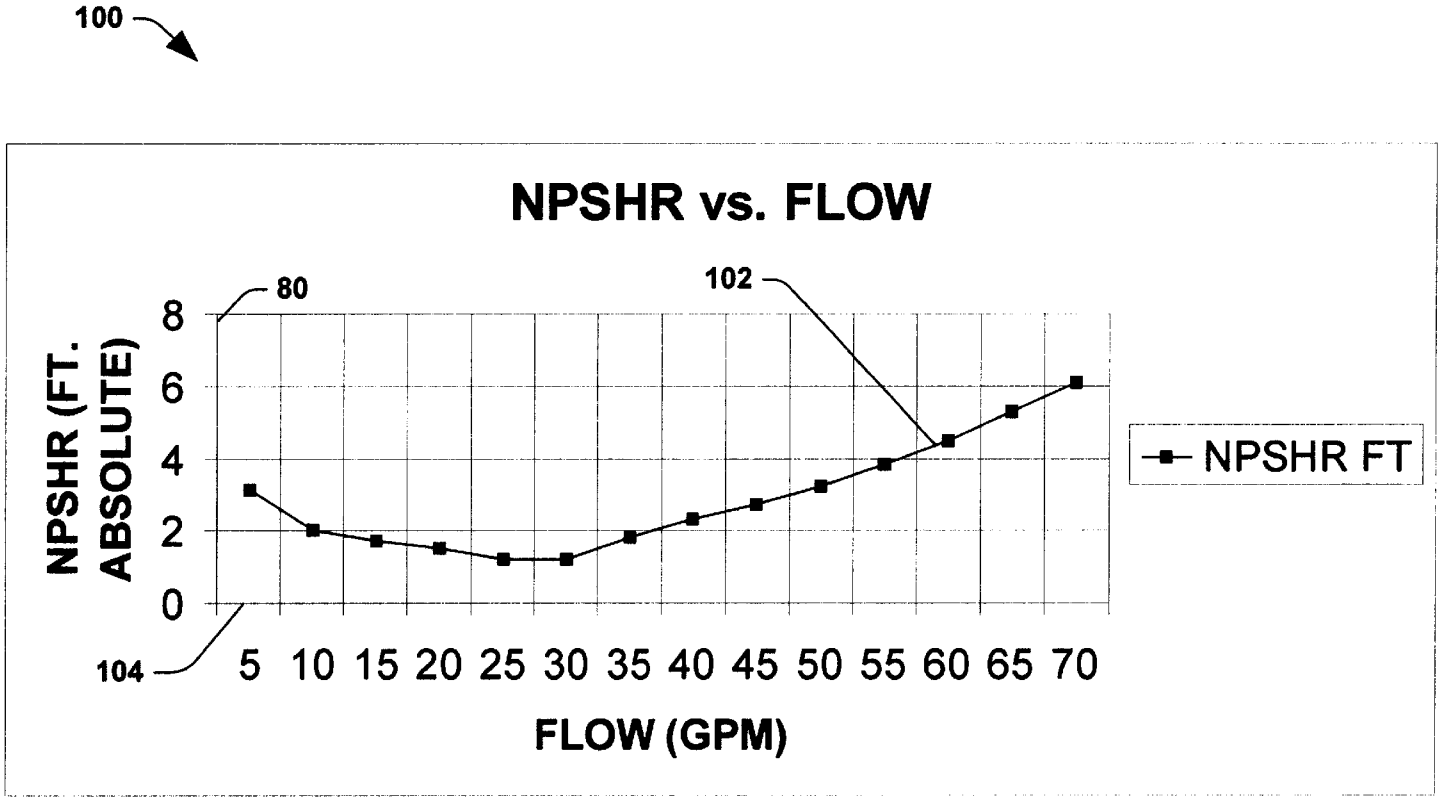
FIG. 4 is an exemplary plot of net positive suction head required versus flow in accordance with the invention.

The values for NPSHR 80 and NPSHA 82 may be ascertained according to one or more values from the sensors 24, 38, 40, 42, 44, 46, and/or 54. For example, the cavitation detection component 70 may determine the NPSHR 80 according to a flow value from the flow sensor 38, along with pump model information, fluid properties, and hydraulic system geometry such as pipe diameters and bends, and the NPSHA 82 according to suction pressure, flow, and temperature values in the pump 4 from signals from sensors 24, 38, and 42, respectively. The NPSHR 80 may be a function of pump flow, wherein the relationship between flow and NPSHR may be characterized for a given pump (e.g., pump 4). Referring also to FIG. 4, a plot 100 illustrates one exemplary curve or relationship 102 between net pressure suction head required (e.g. NPSHR 80), and fluid flow rate 104 in gallons per minute (GPM). The cavitation detection component 70 may ascertain a flow rate value from the flow sensor 38, and determine a corresponding NPSHR value from the curve 102, for example, using a lookup table, or by evaluating a mathematical function representative of the curve 102, via software instructions running in a microprocessor (not shown) in the controller 66.

Similarly, the NPSHA 82 may be ascertained according to suction pressure, flow, and temperature values in the pump 4 from signals from sensors 24, 38, and 42, respectively. For instance, the NPSHA 82 may be found according to the following equation 1 as:

$$NPSHA=h_{sa}+h_{vs}-h_{vp} \text{ in feet,} \tag{1}$$

wherein $h_{sa}$ is suction head in feet absolute; $h_{vs}$ is suction velocity head in feet; and $h_{vp}$ is vapor pressure in feet of head. The value for $h_{sa}$ may be obtained from the measured suction head pressure signal from sensor 24 by the following equation 2:

$$hsa=(Ps*k_1)/s, \tag{2}$$

wherein $k_1$ is a constant s is the specific gravity. The $h_{vs}$ value may be found by multiplying a constant by the square of the flow value from the sensor 38, for example, according to the following equation 3:

$$h_{vs}=k_2*(\text{flow})^2, \tag{3}$$

wherein $k_2$ is a constant related to the hydraulic characteristics of a particular pump system (e.g. pipe diameter), and flow is the measured flow (e.g., as sensed by flow sensor 38). In addition, the value for $h_{vp}$ may be found by a polynomial formula, such as the following equation 4:

$$h_{vp}=(k_3e^{-8})*(T^4)+(k_4e^{-6})*(T^3)+(k_5e^{-3})*(T^2)+(k_6e^{-2})*(T)+k_v, \tag{4}$$

wherein T is the temperature of the pump 4 (e.g., as measured by the temperature sensor 42), and $k_3$–$k_7$ are constants related to the fluid.

It will be appreciated that the above is but one example of detecting actual or suspected cavitation in the pump 4, and that the cavitation detection component 70 of the controller 66 may perform various measurements and/or calculations in order to ascertain the existence of pump cavitation (e.g., actual or suspected) in accordance with the present invention.

Figure 5:
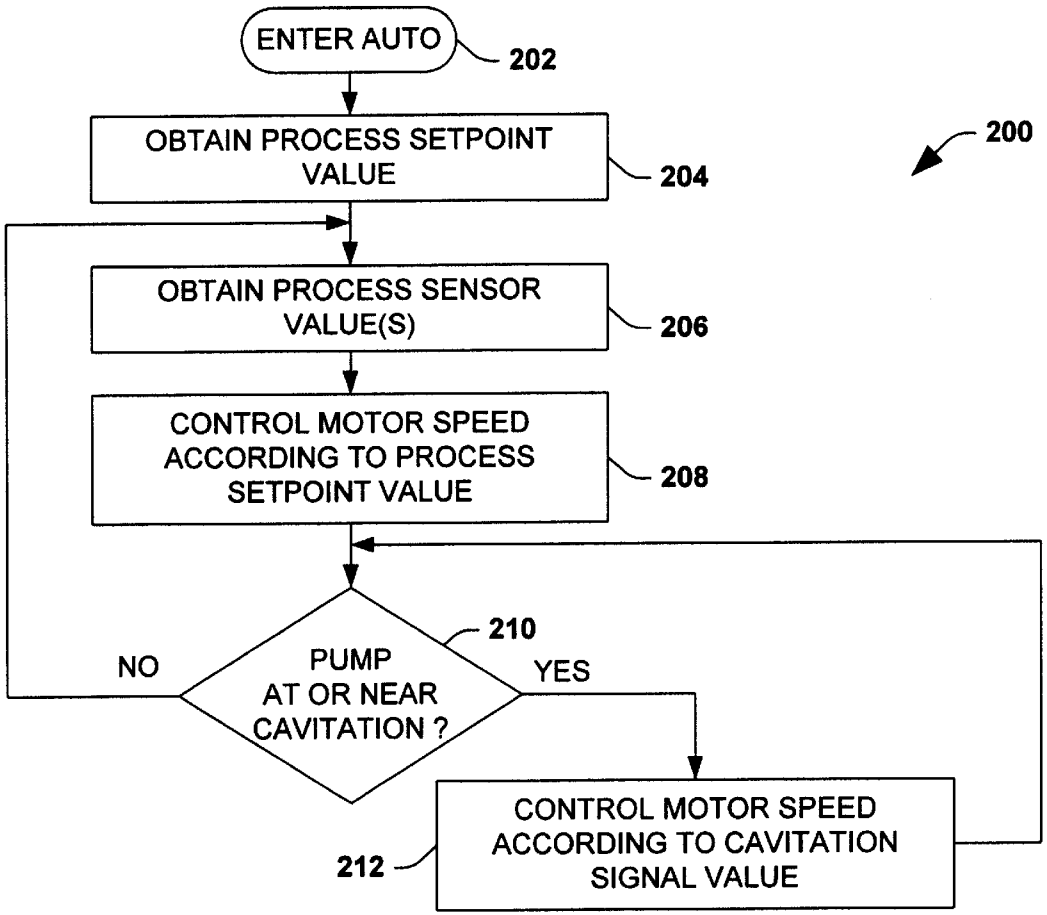
FIG. 5 is a flow diagram illustrating an exemplary method of controlling a motorized pump in accordance with another aspect of the invention.

Referring now to FIG. 5, another aspect of the invention provides a method of controlling a motorized pump (e.g., pump 4 or other pumps), so as to eliminate or reduce the adverse effects of pump cavitation on pump system components. The methodology comprises detecting cavitation in the pump, controlling the pump according to a process setpoint if no cavitation is detected in the pump, and controlling the pump according to a cavitation signal if cavitation is detected in the pump. An exemplary method 200 is illustrated in FIG. 5 for controlling a motorized pump in accordance with the invention. While the exemplary method 200 is illustrated and described herein as a series of blocks representative of various events and/or acts, the present invention is not limited by the illustrated ordering of such blocks. For instance, some acts or events may occur in different orders and/or concurrently with other acts or events, apart from the ordering illustrated herein, in accordance with the invention. Moreover, not all illustrated blocks, events, or acts, may be required to implement a methodology in accordance with the present invention. In addition, it will be appreciated that the exemplary method 200 and other methods according to the invention, may be implemented in association with the pumps and systems illustrated and described herein, as well as in association with other systems and apparatus not illustrated or described.

Beginning at 202, an automatic control mode is entered, after which a process setpoint value (e.g., such as outlet pressure, outlet flow, speed, or the like) is obtained at 204. One or more process sensor values are obtained at 206. For example, process values such as suction pressure, discharge pressure, pump temperature, outlet or discharge fluid flow rate, power, speed, or the like may be obtained, such as from one or more sensors associated with the controlled pump or the process in which the pump is operating. At 208, the speed of the pump motor is controlled according to the process setpoint value (e.g., obtained at 204).

A determination is made at 210 as to whether the pump is at or near cavitation (e.g., actual, suspected, or within a margin that cavitation exists). For instance, the existence or likelihood of pump cavitation may be detected at 210 according to one or more of the process sensor values obtained at 206, such as flow, suction pressure, temperature, or the like. Thus, the determination at 210 may comprise determining whether net positive suction required (e.g., as computed from one or more sensor values) in the pump is greater than net positive suction available in the pump (e.g., as computed from one or more sensor values), and assuming cavitation is likely if net positive suction required in the pump is greater than net positive suction available in the pump.

If cavitation (e.g., actual, likely, or marginal) is not detected at 210, the method 200 returns through 206 and 208 as described above. However, if pump cavitation is detected at 210, the method 200 proceeds to 212, where the pump motor speed is controlled according to a cavitation signal value. The cavitation detection at 210 may comprise determining actual, suspected, or marginal cavitation. For instance, a determination may be made at 210 as to whether the pump is within a user-defined margin from cavitation, wherein the margin may be zero or non-zero. It will be appreciated that marginal or suspected cavitation detection may be accomplished via a comparison of the difference between NPSHA and NPSHR with a threshold, for example, wherein marginal or suspected cavitation may be detected if the difference (e.g., NPSHA–NPSHR) is positive and less than a threshold value, which may be user-defined. Other forms of predicting incipient (e.g., likely or suspected) cavitation may be employed, for example, according to trending, statistical or other condition prediction techniques in accordance with the invention. Thereafter, if cavitation (e.g., actual, suspected, or marginal) is detected at 210, the cavitation control at 212 may comprise slowing motor speed in order to eliminate or alleviate the cavitation condition in the controlled pump.

Alternatively or in combination, the cavitation control at 212 may comprise adjusting the motor speed to ensure a minimum margin from cavitation, wherein resumption of normal setpoint control (e.g., via 206 and 208 above) occurs when a sufficient margin from cavitation has been attained. Thereafter, the determination of whether pump cavitation exists is repeated at 210. Other forms of cavitation control at 212 are contemplated as falling within the scope of the present invention. For example, the pump may be operated at 212 at a stable condition close to the cavitation point, so as to minimize or reduce damage associated with pump cavitation, without returning to normal (e.g., setpoint) control at 206–208. Alternatively, the control at 212 may comprise automatically shutting down the pump if minimum flow cannot be achieved, severe cavitation cannot be eliminated, or excessive motor speed is required to maintain setpoint (e.g., flow setpoint) operation, as well as providing an indication to an operator, and/or subsequently attempting to restart of the motor after such a shut down.

The cavitation control may accordingly adjust the speed of the motor-pump so as to maintain a minimum margin from cavitation until the margin is such that operation is sufficiently away from cavitation that the original setpoint control, 208 may be used to control pump operation. Thus, the invention contemplates determining likely or suspected cavitation before actual cavitation conditions exist, and taking appropriate action to avoid such cavitation. In addition, if the motor speed required to avoid cavitation or cavitation margin will cause the motor to operate below the setpoint minimum flow, then the motor drive may be commanded to stop the motor. In this case the pump may be restarted when static, suction pressure returns to an acceptable level to resume pump operation. A user-entered reset control also may be required to resume pump operation. Alternatively, if the motor speed required to maintain setpoint flow (e.g., or another process setpoint value) will require the motor to exceed a maximum user-specified motor speed, then the drive control signal may be set at the maximum allowable motor speed. Rather than maintaining maximum allowable speed and not achieving the setpoint flow value, the motor drive may optionally be commanded to stop the motor pump system. A user-entered reset command may then be required to resume normal pump operation.

Although the invention has been shown and described with respect to certain illustrated aspects, it will be appreciated that equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (e.g., that is functionally equivalent), even though not structurally equivalent to the disclosed structure, which performs the function in the herein illustrated exemplary aspects of the invention. In this regard, it will also be recognized that the invention includes a system as well as a computer-readable medium having computer-executable instructions for performing the acts and/or events of the various methods of the invention.

In addition, while a particular feature of the invention may have been disclosed with respect to only one of several implementations, such feature may be combined with one or more other features of the other implementations as may be desired and advantageous for any given or particular application. As used in this application, the term "component" is intended to refer to a computer-related entity, either hardware, a combination of hardware and software, software, or software in execution. For example, a component may be, but is not limited to, a process running on a processor, a processor, an object, an executable, a thread of execution, a program, and a computer. Furthermore, to the extent that the terms "includes", "including", "has", "having", and variants thereof are used in either the detailed description or the claims, these terms are intended to be inclusive in a manner similar to the term "comprising."

What is claimed is:

1. A pump control system for operating a pump driven by a motor in a controlled fashion, comprising:

a motor drive providing electric power to operate the motor in a controlled fashion according to a motor control signal; and a controller comprising a cavitation detection component operatively connected to the pump to detect cavitation in the pump;

wherein the controller provides the control signal to the motor drive according to one of a setpoint and a cavitation signal from the cavitation detection component according to detected cavitation in the pump.

2. The pump control system of claim 1, wherein the controller provides the control signal according to the cavitation signal if the cavitation detection component detects cavitation in the pump.

3. The pump control system of claim 1, wherein the controller is operatively coupled to at least one sensor associated with the pump, and provides the control signal to the motor drive according to a sensor signal from the at least one sensor and at least one of the setpoint and the cavitation signal according to detected cavitation in the pump.

4. The pump control system of claim 3, wherein the controller provides the control signal according to the sensor signal and the cavitation signal if the cavitation detection component detects cavitation in the pump.

5. The pump control system of claim 4, wherein the cavitation detection component detects cavitation in the pump according to the sensor signal from the at least one sensor.

6. The pump control system of claim 5, wherein the cavitation detection component detects cavitation in the pump if net positive suction required is greater than net positive suction available.

7. The pump control system of claim 5, wherein the cavitation detection component detects cavitation in the pump if net positive suction required plus a margin is greater than net positive suction available.

8. The pump control system of claim 7, wherein the controller provides the control signal according to the sensor signal and the cavitation signal so as to reduce cavitation in the pump if the cavitation detection component detects cavitation in the pump.

9. The pump control system of claim 7, wherein the controller provides the control signal to the motor drive according to the sensor signal from the at least one sensor and the setpoint if the cavitation detection component does not detect cavitation in the pump.

10. The pump control system of claim 7, wherein the cavitation detection component determines the net positive suction required according to flow and determines the net positive suction available according to suction pressure, flow, and temperature in the pump.

11. The pump control system of claim 1, wherein the cavitation detection component detects cavitation in the pump if net positive suction required in the pump is greater than net positive suction available in the pump.

12. The pump control system of claim 1, wherein the cavitation detection component detects cavitation in the pump if net positive suction required in the pump plus a user-specified margin is greater than net positive suction available in the pump.

13. The pump control system of claim 12, wherein the cavitation detection component determines the net positive suction required according to flow and determines the net positive suction available according to suction pressure, flow, and temperature in the pump.

14. The pump control system of claim 1, wherein the cavitation detection component detects cavitation if cavitation is likely in the pump.

15. The pump control system of claim 14, wherein the cavitation component determines that cavitation is likely if net positive suction required in the pump is greater than net positive suction available in the pump.

16. The pump control system of claim 1, wherein the detected cavitation comprises actual, suspected, or marginal cavitation.

17. A controller for providing a control signal to a motor drive to operate a motorized pump in a controlled fashion, comprising:

a cavitation detection component operatively connected to the pump to detect cavitation in the pump;

wherein the controller provides the control signal to the motor drive according to one of a setpoint and a cavitation signal from the cavitation detection component according to detected cavitation in the pump.

18. The controller of claim 17, wherein the controller provides the control signal according to the cavitation signal if the cavitation detection component detects cavitation in the pump.

19. The controller of claim 17, wherein the controller provides the control signal according to the cavitation signal if the cavitation detection component detects blockage, sensor failure, or mechanical failure in the pump.

20. The controller of claim 19, wherein the control signal comprises one of stopping the pump and restarting the pump.

21. The controller of claim 17, comprising a PID component providing the control signal according to one of the set point and the cavitation signal according to detected cavitation in the pump.

22. The controller of claim 17, wherein the controller is operatively coupled to at least one pump sensor associated with the pump, and provides the control signal to the motor drive according to a sensor signal from the at least one pump sensor and at least one of the setpoint and the cavitation signal according to detected cavitation in the pump.

23. The controller of claim 22, wherein the controller provides the control signal according to the sensor signal and the cavitation signal if the cavitation detection component detects cavitation in the pump.

24. The controller of claim 23, wherein the cavitation detection component detects cavitation in the pump according to the sensor signal from the at least one pump sensor.

25. The controller of claim 24, wherein the cavitation detection component detects cavitation in the pump if net positive suction required is greater than net positive suction available.

26. The controller of claim 24, wherein the controller provides the control signal according to the sensor signal and the cavitation signal so as to reduce cavitation in the pump if the cavitation detection component detects cavitation in the pump.

27. The controller of claim 24, wherein the controller provides the control signal to the motor drive according to the sensor signal from the at least one pump sensor and the setpoint if the cavitation detection component does not detect cavitation in the pump.

28. The controller of claim 24, wherein the cavitation detection component determines the net positive suction required according to flow and determines the net positive suction available according to suction pressure, flow, and temperature in the pump.

29. The controller of claim 17, wherein the cavitation detection component detects cavitation in the pump if net positive suction required in the pump is greater than net positive suction available in the pump.

30. The controller of claim 29, wherein the cavitation detection component determines the net positive suction required according to flow and determines the net positive suction available according to suction pressure, flow, and temperature in the pump.

31. The controller of claim 17, wherein the cavitation detection component detects cavitation if cavitation is likely in the pump.

32. The controller of claim 31, wherein the cavitation component determines that cavitation is likely if net positive suction required in the pump is greater than net positive suction available in the pump.

33. A method of controlling a motorized pump, comprising:

detecting cavitation in the pump;

controlling the pump according to a process setpoint if no cavitation is detected in the pump; and controlling the pump according to a cavitation signal if cavitation is detected in the pump.

34. The method of claim 33, wherein detecting cavitation comprises determining whether cavitation is likely according to at least one parameter associated with the pump.

35. The method of claim 34, wherein the at least one parameter comprises at least one of flow, suction pressure and temperature.

36. The method of claim 34, wherein detecting cavitation comprises:

determining whether net positive suction required in the pump is greater than net positive suction available in the pump; and assuming cavitation is likely if net positive suction required in the pump is greater than net positive suction available in the pump.

37. The method of claim 36, wherein determining whether net positive suction required in the pump is greater than net positive suction available in the pump comprises:

determining net positive suction required according to a flow associated with the pump; and determining net positive suction available according to suction pressure, temperature, and the flow associated with the pump.

38. The method of claim 33, wherein controlling the pump according to the cavitation signal comprises controlling the pump so as to reduce cavitation in the pump.

39. A system for controlling a motorized pump, comprising:

means for detecting cavitation in the pump; and means for controlling the pump according to a process setpoint if no cavitation is detected in the pump, and controlling the pump according to a cavitation signal if cavitation is detected in the pump.

* * * * *